US005570893A

United States Patent [19]

Swande

[11] Patent Number: 5,570,893

[45] Date of Patent: Nov. 5, 1996

[54] BLADE OF AN ICE SKATE

[75] Inventor: Jerker Swande, Stockholm, Sweden

[73] Assignee: Orebroskenan Aktiebolag, Orebro, Sweden

[21] Appl. No.: 481,493

[22] Filed: Jul. 7, 1995

[30] Foreign Application Priority Data

Jan. 29, 1993 [SE] Sweden ..... 9300293

[51] Int. Cl.[6] ..... A63C 1/30

[52] U.S. Cl. ..... 280/11.18

[58] Field of Search ..... 280/11.18, 11.12, 280/11.15, 608, 609

[56] References Cited

U.S. PATENT DOCUMENTS 4,392,658 7/1983 Redmond et al. ..... 280/11.18

FOREIGN PATENT DOCUMENTS 58900 9/1891 Germany ..... 280/11.18
236281 7/1911 Germany ..... 280/11.18
313056 12/1933 Italy ..... 280/11.18

*Primary Examiner*—Richard M. Camby
*Attorney, Agent, or Firm*—Sughrue, Mion, Zinn, Macpeak & Seas

[57] ABSTRACT

An ice-skate blade construction comprising a central runner (5) and at least one side-runner (4) on each side of the main runner. The side runners are arranged so as to make engagement with the ice solely when the blade (2) is inclined so that the angle defined by the blade with the ice is less than 90 degrees by a predetermined value. In order to improve the gliding and manoeuvering properties of the skate blade, the main runner (5) has a discontinuous glide surface which includes at least one part (7) which is not intended to make contact with the ice and which is delimited by two parts that are.

9 Claims, 2 Drawing Sheets

BLADE OF AN ICE SKATE

Figure 1:
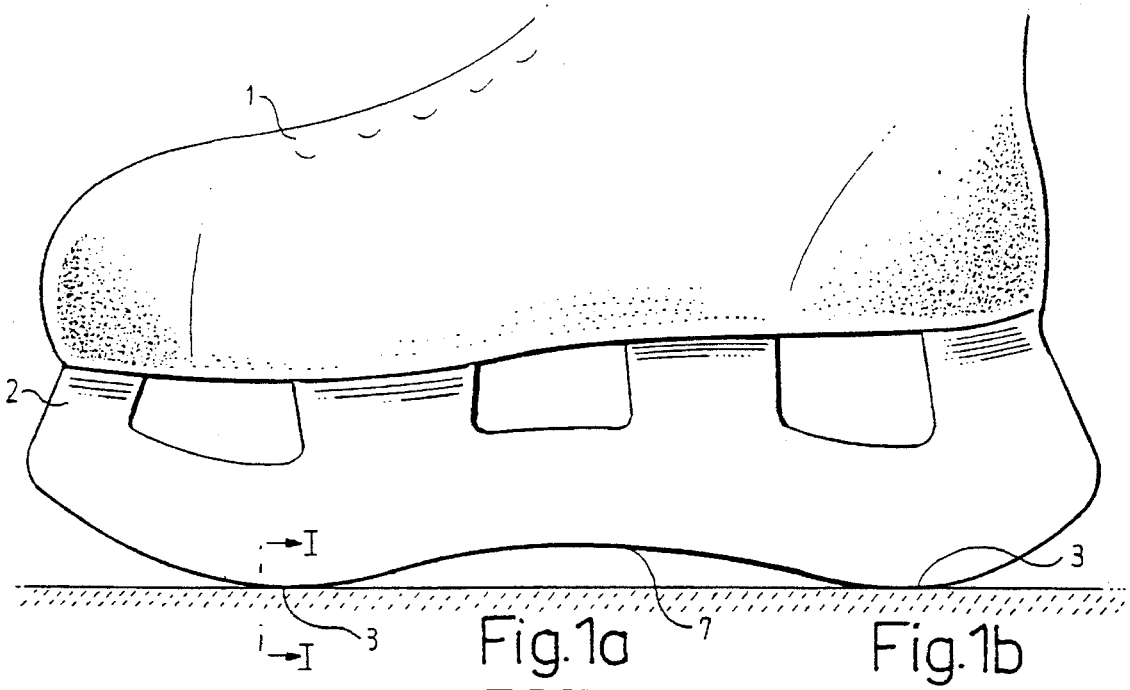

The present invention relates to an ice-skate blade construction comprising a central main runner and at least one side-runner positioned on each side of the main runner, wherein the side-runners are arranged so as to make contact with the surface of the ice only when the blade is inclined so that its angle to the ice will be less than 90° by a predetermined value.

A conventional ice-skate has a continuous elongated blade. Depending on the use for which the ice-skate is intended, the blade will have a particular curvature in its longitudinal direction. For instance, in the case of ice-skates that are intended for speed-skating, the blade is relatively long and generally straight, so as to provide a long abutment surface with the ice. On the other hand, ice-skates which are intended for ice-hockey players have a relatively pronounced curvature in their longitudinal direction, so as to shorten the ice contacting surface and enable the player to turn more effectively. This blade curvature may also vary between skates that are intended for defence players and skates that are intended for attacking players, since the nature of the turns carried out by such players place different demands on the skates worn thereby.

The blade is normally ground hollow, or cupped, so as to provide two ice-engaging edges, thereby to improve blade engagement with the ice. The deeper the hollow, the better the grip obtained. This is achieved, however, at the cost of impaired sliding or skating action, since the edges of deeper hollows will cut deeper into the ice. For this reason, the length over which the blade makes contact with the ice cannot be made excessively short, since the pressure at which the skate bears on the ice, and therewith the extent to which the blade cuts into the ice, will increase successively with successively shorter blades.

The main object of the present invention is to provide an ice-skate blade construction which provides improved sliding or gliding properties while retaining or improving the grip of the skate with the ice and also the ability of the skater to turn.

The invention is based on the realization that these objects can be achieved by means of a blade which has a central main runner and at least one side-runner placed on each side of the central main runner. By using the side-runners, which may have a relatively deep hollow, to achieve effective grip with the ice when making a fast start from a standstill position on the ice and when making turns, the main runner can be given a relatively shallow hollow and therewith improve the gliding properties of the skate.

It has earlier been proposed to utilize side-runners on the sides of a main runner to improve the mechanical strength and stability of the main runner and also to reduce the load acting on the ankle of the skater; see for instance WO 82/00255. Although it has been observed in this respect that this configuration will provide good grip to the ice, this fact has not been utilized in varying the main runner or the manner in which it is ground. A similar construction is described in U.S. Pat. No. 4,392,658.

The inventor of the claimed invention has utilized the fact that the side-runners take over the function of the main runner when accelerating away from a stationary position, when turning on the ice and when skidding to a stop, therewith enabling the configuration and grinding of the main runner to be optimized to obtain the best gliding ability and turning ability of the skate. As before mentioned, an important aspect of skate gliding ability is that the blade will not cut to an unnecessary depth in the ice, while in the case of skate turning ability the length of the blade that abuts the ice should be minimized. Both of these requirements are fulfilled in accordance with the present invention in that the main runner is given a discontinuous glide surface in its longitudinal direction, so that the contact made by the runner with the ice is divided into at least two mutually separate and mutually spaced parts.

According to the present invention, the main characteristic feature of an ice-skate blade of the kind defined in the first paragraph is that the main runner has a discontinuous glide surface in its longitudinal direction which includes at least one part which is not intended to make contact with the ice and which is delimited by two glide parts intended for coaction with the ice.

A blade of this construction thus combines the advantages of good supportability, despite the short total ice abutment length, with a very good ice-gripping action.

With the intention of further reducing resistance to gliding or sliding of the blade, the forward parts of the glide surfaces of the main runner, as seen in the forward direction of movement, are curved in the longitudinal direction so as to provide a successively increasing pressure against the ice.

According to one preferred embodiment, the skate blade includes an outer and an inner side-runner on each side of the main runner, of which side-runners the outer runners are located at a greater height above the glide surfaces of the main runner than the inner side-runners. The side-runners will conveniently follow the general curvature of the main runner in the longitudinal direction, with the exception of areas in the vicinity of the main runner discontinuity or discontinuities.

In the case of a particularly preferred embodiment, the main runner and the side-runners are ground in a common blade. All runners are preferably hollow-ground and include two ice-engaging edges, wherein mutually adjacent runners have a common edge. The main runner will preferably be ground to a shallower hollow than the inner side-runners, which in turn are ground to a shallower hollow than the outer side-runners.

Figure 1A:
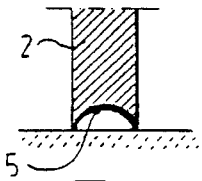
Figure 1B:
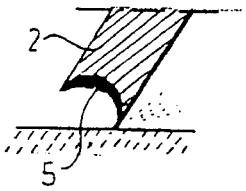
Figure 2:
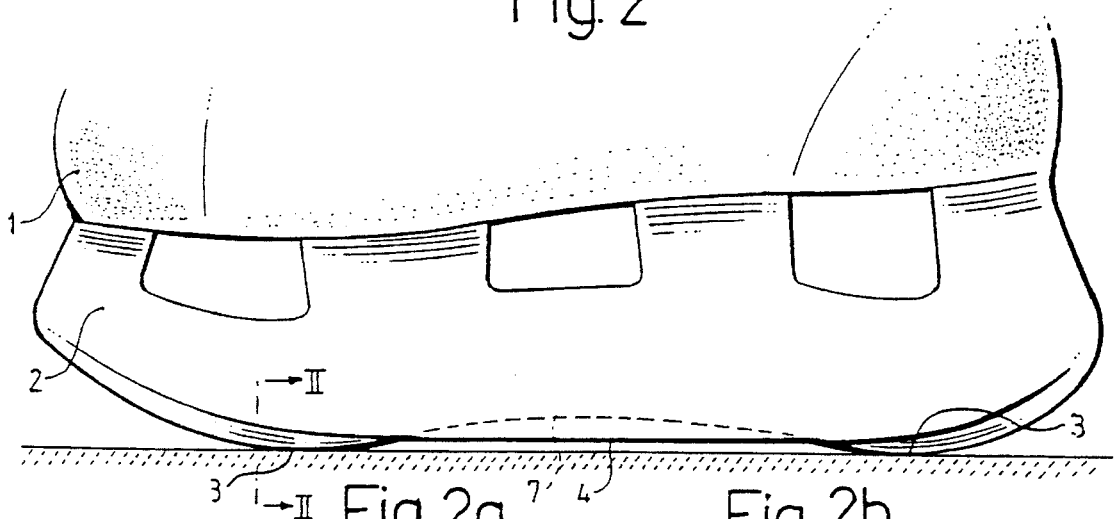
Figure 2A:
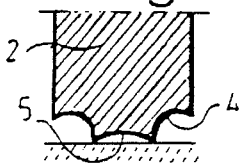
Figure 2B:
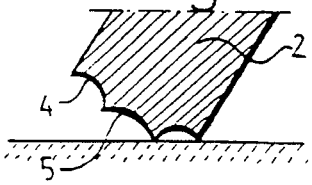
Figure 3:
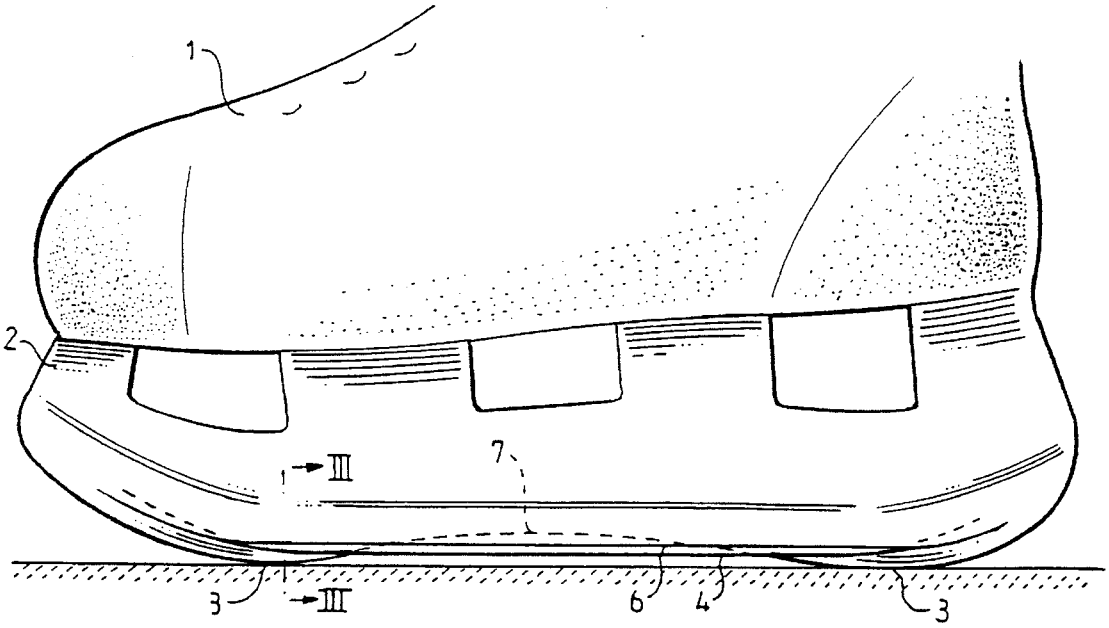
Figure 3A:
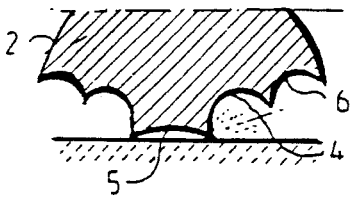
Figure 4:
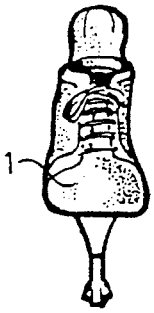
Figure 3B:
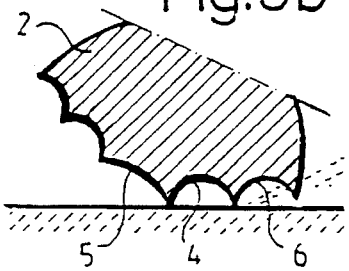
Figure 3C:
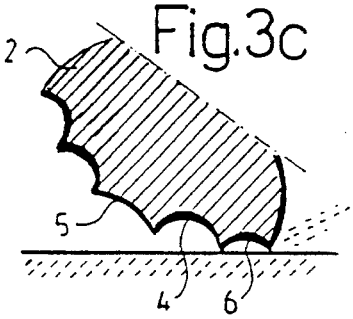

The invention will now be described in more detail with reference to exemplifying embodiments thereof and also with reference to the accompanying drawings, in which FIG. 1 illustrates an ice-skate provided with an inventive blade construction;

FIGS. 1*a* and 1*b* are enlarged sectional views taken on the line I—I in FIG. 1 and shown at different angles to the ice;

FIG. 2 illustrates an inventive blade construction which includes a pair of side-runners;

FIGS. 2*a* and 2*b* are enlarged sectional views taken on the line II—II in FIG. 2 at different angles to the ice;

FIG. 3 illustrates a further development of the blade construction shown in FIG. 2, this further development including two pairs of side-runners;

FIGS. 3*a*, 3*b*, and 3*c* are enlarged sectional views taken on the line III—III in FIG. 3, at different angles to the ice; and FIG. 4 is a front view of an ice-skate provided with a blade construction according to FIG. 3.

Shown in FIG. 1 is a hockey skate 1 which includes a main blade 2 which has been ground to a conventional hollow or cupped shape (see FIG. 1*a*) so as to provide requisite gripping to the ice when making a fast start from a standstill position, when making turns on the ice and when skidding to a stop. When the skate glides forwards in a straight line, the two edges of the blade will be in contact with the ice (see FIG. 1*a*), whereas when the skate is tilted, only one or the other edge will be in contact with the ice (see FIG. 1*b*). It is necessary to adapt the extent of the hollow to the individual requirements of the player so as to achieve a balance between good engagement with the ice and good gliding ability of the skate. The deeper the hollow, the better the engagement of the blade with the ice, although at the cost of the ability of the blade to glide. The depth of the hollow must also be adapted to the weight of the player concerned and to the hardness of the ice.

A conventional hockey-skate blade will be curved in its longitudinal direction in a manner to provide a relatively short ice-abutment surface, this curve in the blade being located generally centrally beneath the foot. The length of the ice-abutment surface is adapted to the requirements of the individual, where-with a defence player will normally desire a shorter abutment surface than an attacking player, so as to obtain better turning ability. However, the abutment surface cannot be made too short, because the surface pressure would then become so great as to cause the blade to bite much too deeply into the ice.

The glide surface of the main blade 2 of the ice-skate illustrated in FIG. 1 has been divided into two mutually separate glide-parts 3, thereby enabling a very short total abutment surface to be used while retaining supportability. In this regard, it is important that the forward parts of the two glide-parts 3 are curved in the longitudinal direction such that the pressure exerted on the ice will only increase successively. In this way, it is possible to obtain a surf-like effect which improves gliding of the skate. Although the effect has still not been fully established, it is assumed that the friction generated by the rear glide-part 3 decreases as a result of the rear glide-part following in the track left by the front glide-part, which as a result of the heat generated by the friction of the forward glide part against the ice melts the track to form a thin film of water which lowers the frictional engagement of the rear glide-part with the ice. A skate blade which is modified in this way provides good maneuverability and an effective ice anchorage. An abrupt or sharp turn can thus be made with essentially the whole body weight concentrated on solely the rear glide-part. Because the very short total glide-surface is divided into two longitudinally separated glide-parts, improved stability in the longitudinal direction of the skate is also achieved.

In order to further improve these properties, the skate blade described above with reference to FIG. 2 is supplemented with a side-runner 4 on each side of the main blade runner 5, see also FIG. 2*a*. The side-runners 4 are continuous and extend parallel with the glide-parts 3 of the main runner 5, but are located at given heights above the glide surfaces of said glide-parts.

When skating forwards in a straight line, solely the main runner 5 will be in contact with the ice, see FIG. 2*a*, whereas when making a fast start from a standstill position, or when turning on the ice and when skidding to a stop, the blade 2 will instead define an angle with the ice such that one of the side-runners 4 will be in engagement with the ice, see FIG. 2*b*.

This embodiment enables the main runner 5 to be ground to a shallower hollow or to be ground flat so as to reduce the extent to which the blade cuts into the ice and therewith the friction of the blade against the ice when solely the main runner is used. This can be achieved as a result of the side-runners 4, which can be given a relatively deep hollow, taking over the function of providing a positive grip on the ice, which is necessary in the aforesaid maneuvers in which the blade is angled relative to the ice. A blade which is modified in the aforedescribed manner thus combines the advantages of very low friction against the ice, good engagement with the ice when curve skating, among other things, and good skating maneuverability.

FIG. 3 illustrates an ice-skate provided with a blade 2 which is a further improvement of the blade shown in FIG. 2, this further blade development including an inner side-runner 4 and an outer side-runner 6 on each side of the main runner 5. As with the blade of the FIG. 2 embodiment, the main runner 5 of this further blade development may be ground to a very shallow hollow or may be ground flat so as to reduce friction, while the blade can be imparted an improved stop ability by the addition of a very sharp outer side-runner 6.

In this case, when skating in a straight line forwards, the blade will coact with the ice in the manner illustrated in FIG. 3*a*, whereas when making a fast start from a standstill position and when curve skating, at least the inner side-runner 4 will be used, see FIG. 3*b*. When performing an abrupt stop skid, the blade will be angled to an extent such that the outer side-runner 6 will make engagement with the ice, see FIG. 3*c*, therewith stopping the skater within a very short distance. This runner can also be used to perform very abrupt turns and fast starts from a standstill position respectively.

For the sake of simplicity, the Figures do not show the blade sections biting into the surface of the ice, and the illustrated blade sections thus correspond to conditions that prevail when skating on very hard ice. The principles, however, are the same even when skating on looser ice, where the edges of the runners cut relatively deeply into the ice. The depth to which the hollows of respective runners are ground should thus be adapted to the quality of the ice concerned and also to the weight of the skater.

As illustrated, it is preferred that all runners are bevel-ground in a steel blade which is common to all runners and which may either be secured to the footwear in a conventional manner or be fastened to a plastic blade which is fastened to the footwear in turn. The blades may also be made so as to be replaceable. The inventive blade may also be comprised of several mutually joined thin blades, each representing a blade runner.

If found suitable, the main runner may also include a glide surface having more than one discontinuity. In certain instances, it may be sufficient for the side-runner or side-runners to extend over that part of the main blade which does not make contact with the ice. The main runner may optionally be ground flat when using side-runners. The hollow ground in the blade may also be varied in relation to what is shown in the drawings, for instance may present a generally flat side surface or be comprised of two flat surfaces which define an angle therebetween.

It will be understood that the inventive principles may also be used for skates intended for other purposes than those mentioned, such as ice-bandy, speed-skating and long-distance skating. The variations required by the special requirements placed on the blade with each separate application can be determined by the person skilled in this art and lie within the scope of the present invention.

I claim:

1. An ice-skate blade comprising a central main runner (5) and at least one side-runner (4) on each side of the main runner, wherein the side-runners are arranged so as to make contact with the surface of the ice solely when the blade (2) is inclined so that the angle defined by the blade with the ice is less than 90° by a predetermined value, characterized in that the main runner (5) has in its longitudinal extension a discontinuous glide surface which includes at least one part (7) which is not intended to make contact with the ice and which is delimited by two glide-parts (3) intended for coaction with the ice.

2. A blade construction according to claim 1, characterized in that the front parts of the main-runner glide-parts (3), as seen in the direction of travel, have a curvature in the longitudinal direction which generates successively increasing pressure against the ice.

3. A blade construction according to claim 1, characterized in that the blade includes an outer and an inner side-runner (4; 6) on each side of the main runner (5); and in that the outer side-runners (6) are located at a greater height above the glide surface of the main runner (5) than are the inner side-runners (4).

4. A blade construction according to claim 1, characterized in that the side-runners (4; 6) follow the general curvature of the main runner (5) in the longitudinal direction except at the locations of the discontinuity (7) or discontinuities in the main runner.

5. A blade construction according to claim 1, characterized in that the main runner (5) and the side-runners (4; 6) are ground in a blade (2) which is common to all runners.

6. A blade construction according to claim 5, characterized in that all runners (4–6) are ground hollow and each includes two ice-engagement edges.

7. A blade construction according to claim 6, characterized in that mutually adjacent runners have a mutually common edge.

8. A blade construction according to claim 6, characterized in that the hollow of the main runner (5) is shallower than the hollow of the side-runners (4; 6).

9. A blade construction according to claim 6, characterized in that the hollow of the main runner (5) is shallower than the hollow of the inner side-runners (4); and that the hollow of the inner side-runners (4) is shallower than the hollow of the outer side-runners (6).

* * * * *